US008353575B2

(12) United States Patent
Yoshida

(10) Patent No.: US 8,353,575 B2
(45) Date of Patent: Jan. 15, 2013

(54) NOZZLE SHEET AND METHOD FOR MANUFACTURING THE SAME

(75) Inventor: Yuko Yoshida, Takatsuki (JP)

(73) Assignee: Konica Minolta Holdings, Inc. (JP)

( * ) Notice: Subject to any disclaimer, the term of this patent is extended or adjusted under 35 U.S.C. 154(b) by 174 days.

(21) Appl. No.: 12/921,923

(22) PCT Filed: Apr. 22, 2009

(86) PCT No.: PCT/JP2009/057970

§ 371 (c)(1),
(2), (4) Date: Sep. 10, 2010

(87) PCT Pub. No.: WO2009/133794

PCT Pub. Date: Nov. 5, 2009

(65) Prior Publication Data

US 2011/0032308 A1 Feb. 10, 2011

(30) Foreign Application Priority Data

Apr. 30, 2008 (JP) ..... 2008-117991

(51) Int. Cl.
*B41J 2/16* (2006.01)

(52) U.S. Cl. ..... 347/47; 29/611; 347/19; 347/45; 347/50; 347/63; 347/68; 427/201; 430/320

(58) Field of Classification Search ..... None
See application file for complete search history.

(56) References Cited

U.S. PATENT DOCUMENTS

| | | | | |
|---|---|---|---|---|
| 6,176,571 | B1 * | 1/2001 | Kishima et al. | 347/70 |
| 2006/0066676 | A1 * | 3/2006 | Sanada | 347/50 |
| 2006/0209139 | A1 * | 9/2006 | Murata | 347/71 |
| 2007/0285456 | A1 * | 12/2007 | Takasu et al. | 347/19 |
| 2010/0020131 | A1 * | 1/2010 | Nishi | 347/68 |

FOREIGN PATENT DOCUMENTS

| | | | |
|---|---|---|---|
| JP | 5-318743 | A | 12/1993 |
| JP | 6-40039 | A | 2/1994 |
| JP | 6-143587 | A | 5/1994 |
| JP | 2002-127430 | A | 5/2002 |
| JP | 2005-279946 | A | 10/2005 |
| WO | WO 2009/133794 | A1 | 11/2009 |

* cited by examiner

*Primary Examiner* — Matthew Luu
*Assistant Examiner* — John P Zimmermann
(74) *Attorney, Agent, or Firm* — Cantor Colburn LLP

(57) ABSTRACT

Provided is a nozzle sheet manufacturing method by which highly fine manufacture and low cost are achieved. The method for manufacturing a nozzle sheet to be used for an inkjet head for an inkjet printer is provided with a step of forming a first resin sheet on a patterned liquid repellent film on a first dummy substrate, a step of forming a first nozzle which penetrates the first resin sheet, and a step of peeling the first dummy substrate.

13 Claims, 8 Drawing Sheets

NOZZLE SHEET AND METHOD FOR MANUFACTURING THE SAME

RELATED APPLICATIONS

This application is a U.S. National Phase Application under 35 U.S.C. 371 of International Application No. PCT/JP2009/057970, filed with Japanese Patent Office on Apr. 22, 2009, which claims priority to Japanese Patent Application No. 2008-117991, filed Apr. 30, 2008.

TECHNICAL FIELD

The present invention relates to a nozzle sheet for use in an inkjet head for an inkjet printer, and to a method of manufacture of such a nozzle sheet.

BACKGROUND ART

Recent years have seen a rapid spread of inkjet printers for their advantages such as high-speed printing, low operating noise, high-resolution printing, and low cost. For an inkjet printer to achieve high-resolution printing, ink needs to be formed into a meniscus shape at the exit of a nozzle and be propelled stably and orthogonally to the printed surface. If the exit surface of the nozzle becomes wet and spread with ink, no stable meniscus shape is obtained, and thus high-resolution printing cannot be achieved. This is generally coped with by providing a liquid-repellent film on the exit surface of the nozzle. For example, in a case where a nozzle is formed on a nozzle plate, which is the tip-end part of an inkjet head, a liquid-repellent film is typically formed on the exit-side surface of the nozzle plate. Various methods have been proposed for formation of such a liquid-repellent film.

For example, according to a method disclosed in Patent Document 1 listed below, liquid-repellent agent is absorbed in sponge, and is then transferred to a nozzle exit surface. On the other hand, according to a method disclosed in Patent Document 2 listed below, a nozzle plate is treated to be liquid-repellent, and is then attached to a dummy substrate; then, nozzle holes are formed by etching.

RELATED-ART DOCUMENTS

Patent Documents

Patent Document 1: JP-A-H6-143587

Patent Document 2: JP-A-H5-318743

DISCLOSURE OF THE INVENTION

Problems to be Solved by the Invention

Inconveniently, however, according to the method disclosed in Patent Document 1, the procedure so proceeds that liquid-repellent agent is transferred after nozzles are formed, and this may let the liquid-repellent agent pass into the nozzles. Avoiding that requires control that is extremely difficult and costly. Moreover, the use of sponge, which is a porous material, may result in uneven transfer.

On the other hand, according to the method disclosed in Patent Document 2, the nozzle plate is a glass plate, and is therefore sufficiently thick and strong. This makes liquid-repellent treatment possible before attachment of the nozzle plate to the dummy substrate; also the nozzle plate can be held even without a bonding portion near where nozzles are formed. With this method, however, in a case where, with low profile and low cost in mind, a nozzle plate is assumed to be a thin resin sheet, which is not sufficiently thick or strong, the nozzle plate bends when nozzles are formed, and thus cannot be so processed.

An object of the present invention is to provide a nozzle sheet free from the inconveniences discussed above and offering high resolution combined with low cost, and to provide a method of manufacture of such a nozzle sheet.

Means for Solving the Problem

To achieve the above object, according to one aspect of the present invention, a method for manufacturing a nozzle sheet used for an inkjet head for an inkjet printer includes the steps of: forming a first resin sheet on a liquid-repellent film patterned on a first dummy substrate; forming a first nozzle which penetrates the first resin sheet; and peeling the first dummy substrate off.

In the nozzle sheet manufacturing method described above, it is preferable that the first resin sheet be made of light curable resin.

In the nozzle sheet manufacturing method described above, the first resin sheet may be made of dry film resist.

In the nozzle sheet manufacturing method described above, it is preferable that the first nozzle forming step includes the steps of: exposing the first resin sheet to ultraviolet radiations through a photomask; baking the first resin sheet to make the first resin sheet crosslink; and dissolving the part other than the crosslinked part of the first resin sheet with developer.

In the nozzle sheet manufacturing method described above, it is preferable that the method further includes, between the first nozzle forming step and the first dummy substrate peeling step, the steps of: forming a second resin sheet on the first resin sheet; and forming a second nozzle which penetrates the second resin sheet and leads to the first nozzle, the diameter of the second nozzle being larger than that of the first nozzle.

In the nozzle sheet manufacturing method described above, it is preferable that the second resin sheet be made of light curable resin.

In the nozzle sheet manufacturing method described above, the second resin sheet may be made of dry film resist.

In the nozzle sheet manufacturing method described above, it is preferable that the second nozzle forming step includes the steps of: exposing the second resin sheet to ultraviolet radiations through a photomask; baking the second resin sheet to make the second resin sheet crosslink; and dissolving the part other than the crosslinked part of the second resin sheet with developer.

In the nozzle sheet manufacturing method described above, it is preferable that the area of the patterned liquid-repellent film on the second resin sheet is five times or more larger than the exit area of the first nozzle.

In the nozzle sheet manufacturing method described above, it is preferable that the first dummy substrate having the liquid-repellent film patterned thereon be prepared by the steps of: forming an adhesion layer on the first dummy substrate; putting a liquid-repellent agent masking film on the adhesion layer; forming a liquid-repellent material over the liquid-repellent agent masking film; drying and solidifying the liquid-repellent material; and peeling the liquid-repellent agent masking film off, the first dummy substrate being peeled off by using adhesion layer remover.

In the nozzle sheet manufacturing method described above, it is preferable that the liquid-repellent agent masking film be prepared by the steps of: forming a sacrificial layer on a second dummy substrate; forming a dry film resist layer as a masking film on the sacrificial layer; exposing the masking film to ultraviolet radiations through a photomask; baking the masking film to make the masking film crosslink; dissolving the part other than the crosslinked part of the masking film with developer; and peeling the second dummy substrate off by using sacrificial layer remover.

According to another aspect of the present invention, a nozzle sheet is manufactured by the nozzle sheet manufacturing method described above.

Advantages of the Invention

According to the present invention, it is possible to form the liquid-repellent film only on the exit surface of the first nozzle. This permits ink to be formed into a meniscus shape at the exit of the first nozzle, and permits ink to be propelled stably and orthogonally to the printed surface, thus high-resolution printing can be achieved. Moreover adopting a nozzle sheet made of resin helps to achieve cost reduction compared with a glass plate as conventionally used.

BRIEF DESCRIPTION OF DRAWINGS

BEST MODE FOR CARRYING OUT THE INVENTION (1) Liquid-Repellent Agent Masking Film First, a description will be given of a liquid-repellent agent mask, which is a patterning mask for formation of a liquid-repellent film. FIGS. 1(*a*) to 1(*e*) are sectional views showing respective steps of forming a liquid-repellent agent mask.

Figure 1A:
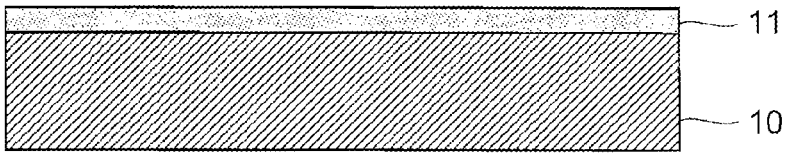
FIGS. 1(*a*) to 1(*e*) are sectional views showing respective steps of forming a liquid-repellent agent mask according to the invention.
Figure 1B:
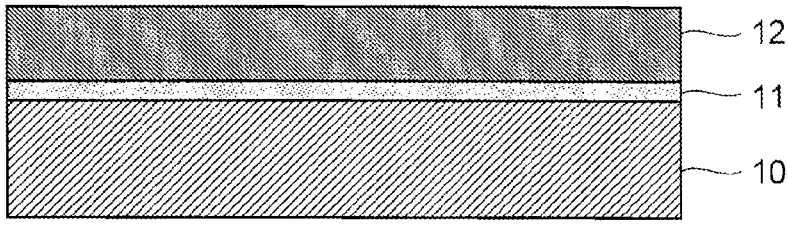
Figure 1C:
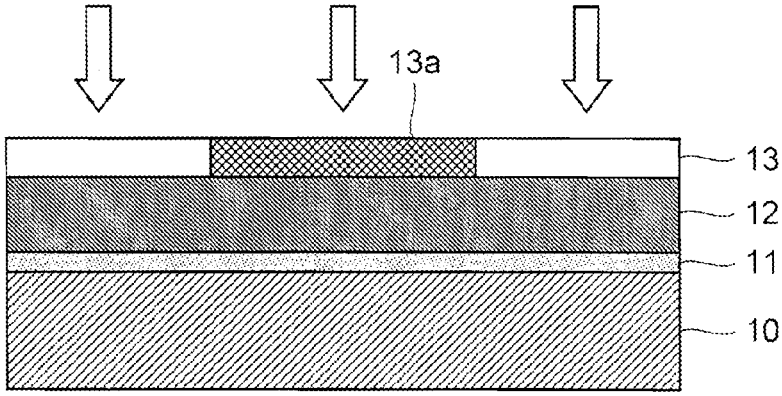
Figure 1D:
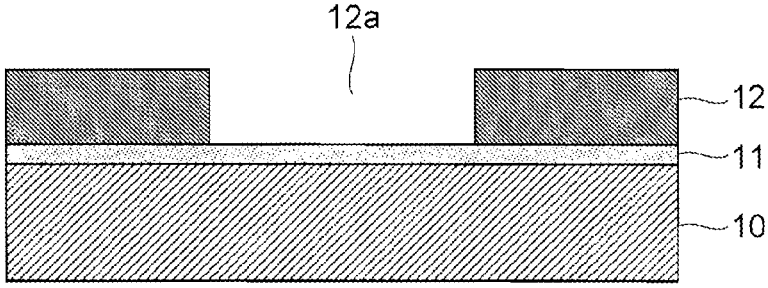
Figure 1E:
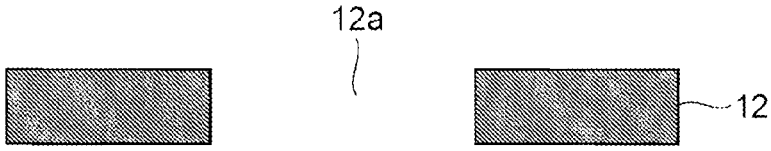

First, as shown in FIG. 1(*a*), on a dummy substrate (second dummy substrate) 10, a sacrificial layer (adhesion layer) 11 is formed. The dummy substrate 10 may be made of any heat-resistant material giving a smooth surface, examples including Si, glass, and metal. The sacrificial layer 11 may be made of any material that can temporarily bond a masking film, which will be described later, to the dummy substrate 10 and that can be removed later, examples including positive resist.

Next, as shown in FIG. 1(*b*), on the sacrificial layer 11, a masking film 12 made of dry film resist (DFR) is formed. Examples of DFR include SU-8 manufactured by Kayaku MicroChem Corporation. The thickness of DFR is typically determined within the range of from 5 μm to 200 μm with consideration given to handling and cost requirements.

Next, as shown in FIG. 1(*c*), the masking film 12 is exposed to ultraviolet radiations of predetermined intensity for a predetermined duration through a photomask 13 having a desired liquid-repellent film pattern 13*a* formed in it. The pattern 13*a* is given a circular shape here, but may instead be given any other shape, examples including elliptic and polygonal shapes. The intensity of, and the duration of exposure to, ultraviolet radiations may be properly determined according to the thickness of the masking film. Next, through baking on a hot plate, the part of the masking film 12 irradiated with ultraviolet radiations is made to crosslink.

Next, as shown in FIG. 1(*d*), the part of the masking film 12 other than its crosslinked part is dissolved with DFR developer liquid. Thus, in the masking film 12, a through hole 12*a* according to the pattern 13*a* is formed.

Next, as shown in FIG. 1(*e*), through immersion in sacrificial layer remover, the sacrificial layer 11 is dissolved, and thereby the dummy substrate 10 is peeled off. Thus, a liquid-repellent agent masking film 12 having the through hole 12*a* formed in it is obtained.

Figure 2:
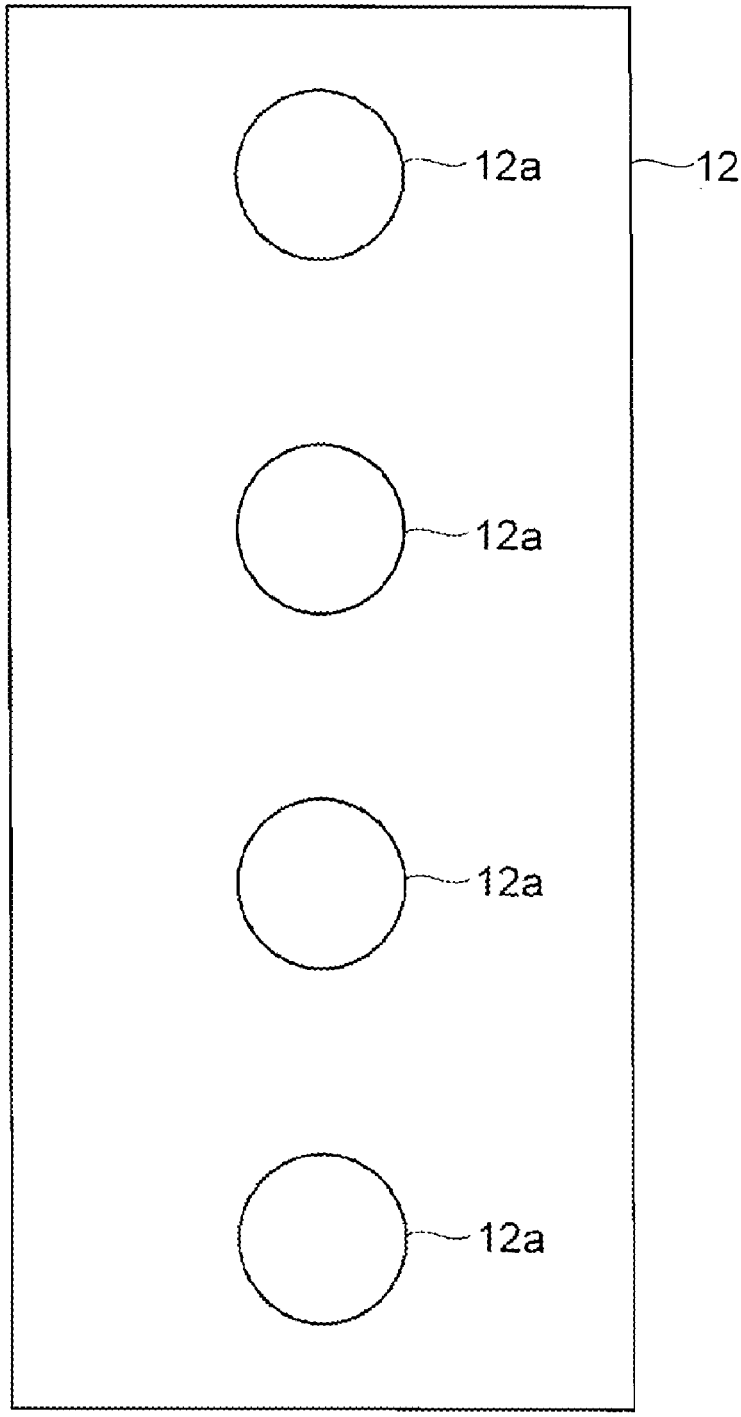
FIG. 2 is a plan view of a liquid-repellent agent masking film according to the invention.
Figure 3A:
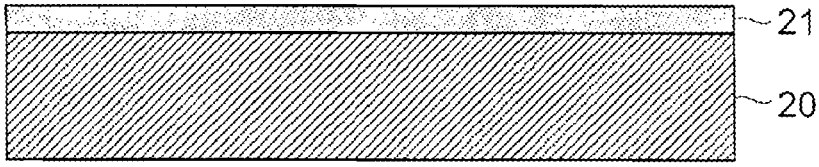
FIGS. 3(*a*) to 3(*d*) are sectional views showing respective steps of forming a dummy substrate having a liquid-repellent film patterned on it according to the invention.
Figure 3B:
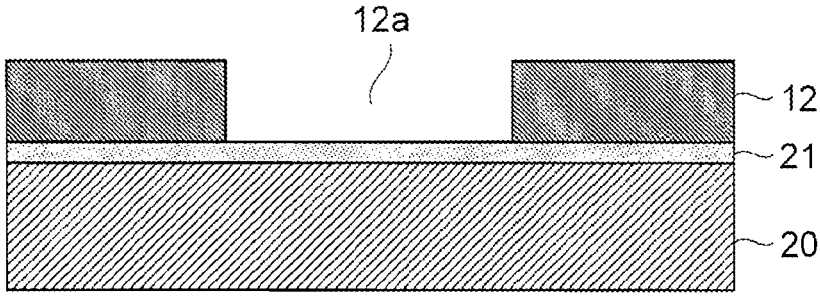
Figure 3C:
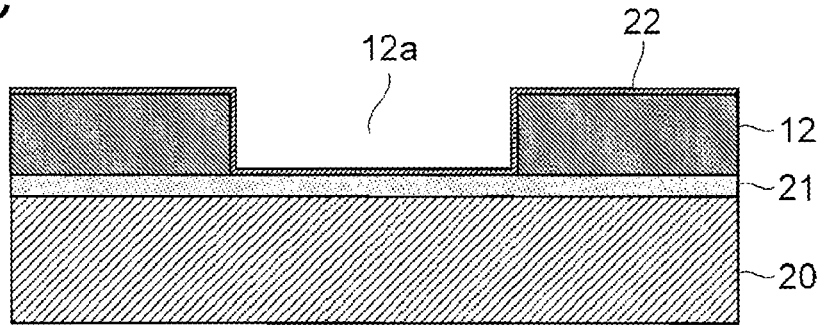
Figure 3D:
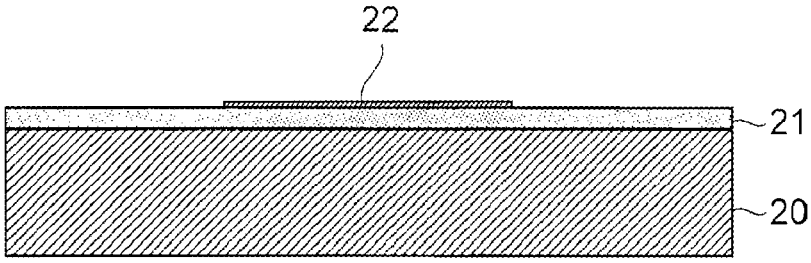

FIG. 2 is a plan view of the liquid-repellent agent masking film 12. Although in FIG. 2 the liquid-repellent agent masking film 12 has four through holes 12*a* formed in it, in practice the number and arrangement of through holes 12*a* are to be determined to suit a desired nozzle arrangement; for example, a larger number of through holes may be arranged in one row, or they may be arranged in plural rows.

(2) Dummy Substrate Having a Liquid-Repellent Film Patterned on it

Next, a description will be given of formation of a liquid-repellent film on a dummy substrate. FIGS. 3(*a*) to 3(*d*) are sectional views showing respective steps of forming a dummy substrate having a liquid-repellent film patterned on it.

First, as shown in FIG. 3(*a*), on a dummy substrate (first dummy substrate) 20, an adhesion layer (sacrificial layer) 21 is formed. The dummy substrate 20 may be made of any heat-resistant material giving a smooth surface, examples including Si, glass, and metal. The adhesion layer 21 may be made of any material that can temporarily bond a masking film, which will be described later, to the dummy substrate 10 and that can be removed later, examples including positive resist.

Next, as shown in FIG. 3(*b*), the liquid-repellent agent masking film 12 is put on (attached to) the adhesion layer 21.

Next, as shown in FIG. 3(*c*), through immersion in liquid-repellent agent followed by lifting up out of it at constant speed, the surface of the liquid-repellent agent masking film 12, the inside of the through hole 12*a*, and the surface of the adhesion layer 21 exposed inside the through hole 12*a* are coated with the liquid-repellent agent. Thereafter, the liquid-repellent agent is dried and solidified, and thus a liquid-repellent film 22 is obtained.

Next, as shown in FIG. 3(*d*), the liquid-repellent agent masking film is peeled off. Thus, a dummy substrate 20 is obtained which has the liquid-repellent film 22 patterned only on the part of the surface of the adhesion layer 21 exposed inside the through hole 12*a*.

Figure 4:
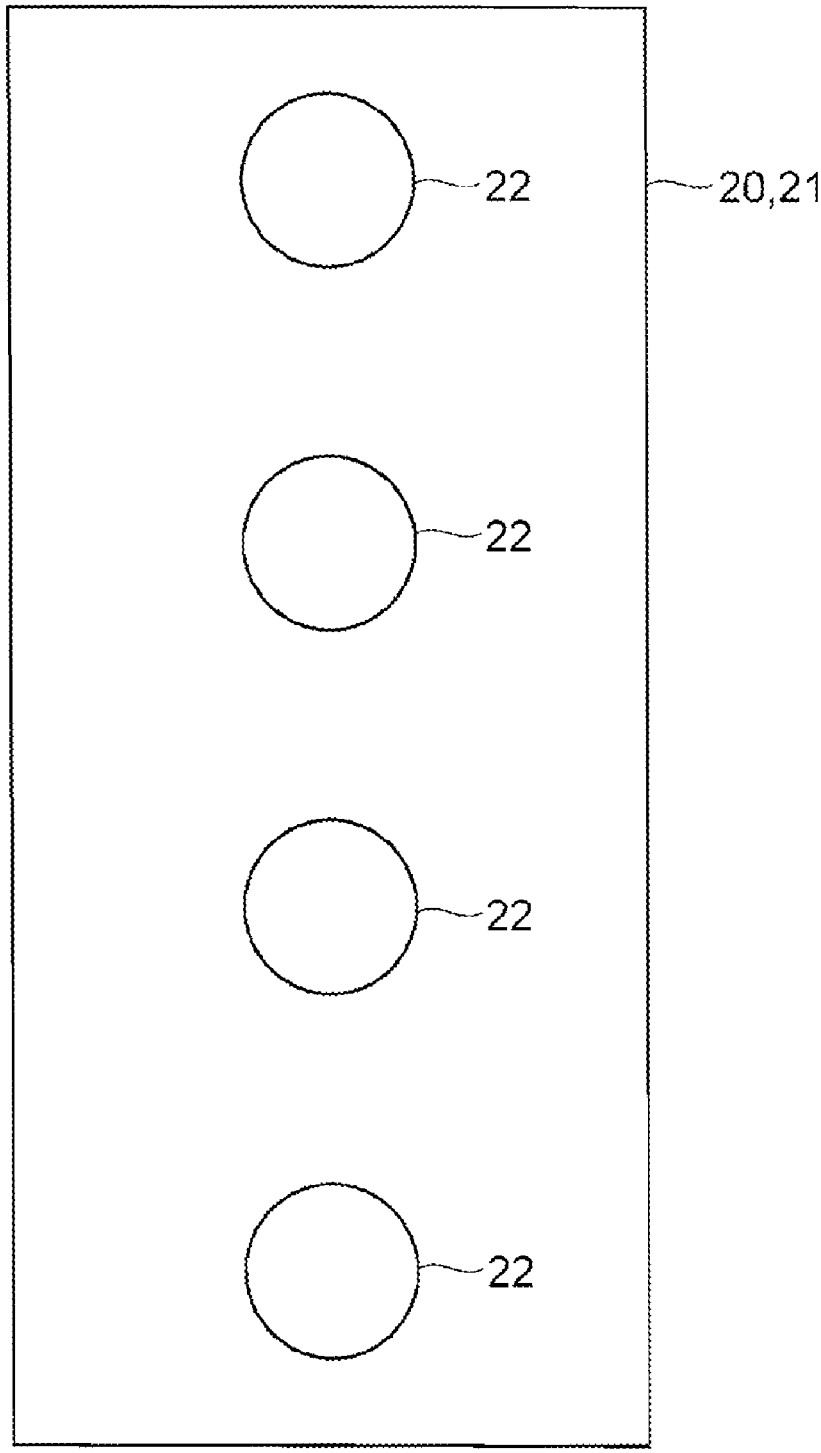
FIG. 4 is a plan view of a dummy substrate having liquid-repellent films patterned on it according to the invention.

FIG. 4 is a plan view of the dummy substrate 20 having liquid-repellent films 22 patterned on it. Although in FIG. 4 the dummy substrate 20 has the liquid-repellent films 22 formed at four places on it, in practice the number and arrangement of liquid-repellent films 22 are to be determined to suit a desired nozzle arrangement; for example, a larger number of liquid-repellent films may be arranged in one row, or they may be arranged in plural rows.

The liquid-repellent film 22 may be patterned on the dummy substrate 20 by any other method than described above. Examples of such methods include lift-off process using liquid resist, and a method involving application of liquid-repellent agent to a mold having a pattern of the liquid-repellent film 22 convexly formed (embossed) on it followed by transfer of the liquid-repellent agent to the dummy substrate 20.

(3) Nozzle Sheet

Figure 5A:
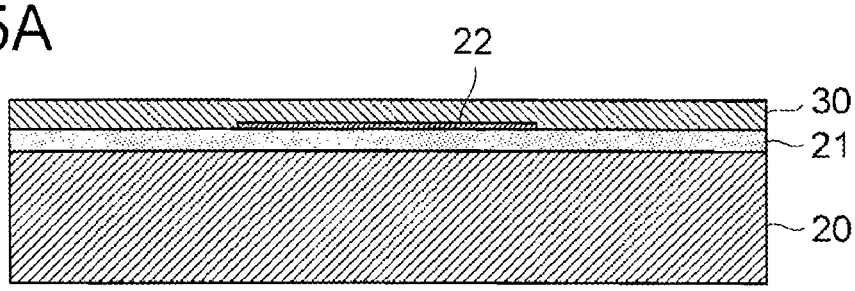
FIGS. 5(*a*) to 5(*c*) are sectional views showing respective steps of forming a nozzle sheet according to the invention.
Figure 5B:
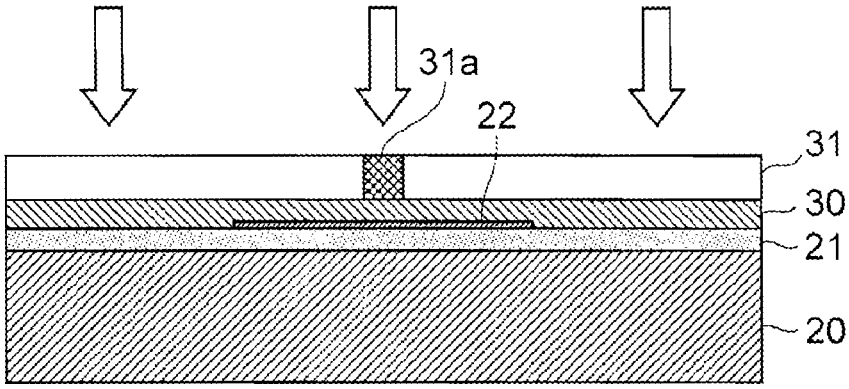
Figure 5C:
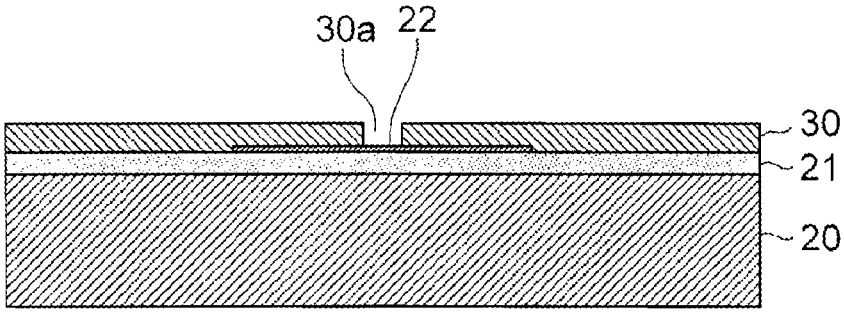
Figure 6A:
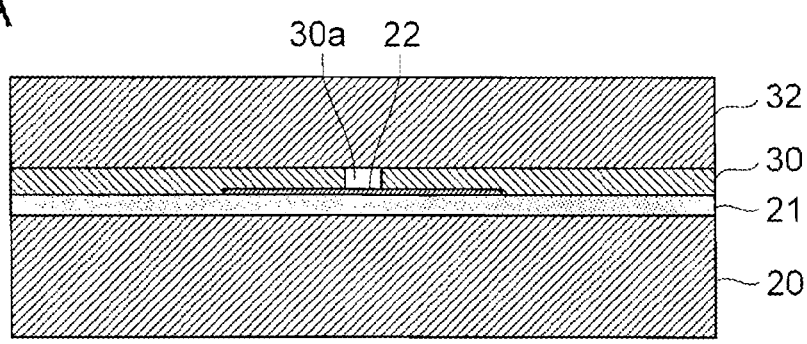
FIGS. 6(*a*) to 6(*d*) are sectional views showing respective steps of forming a nozzle sheet according to the invention.
Figure 6B:
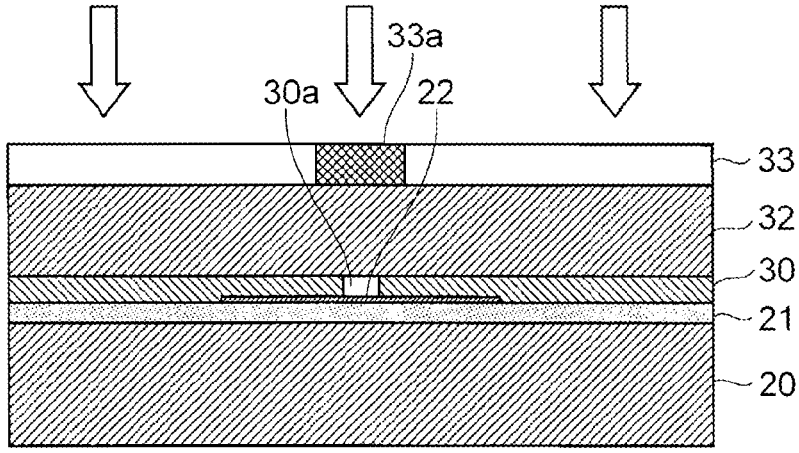
Figure 6C:
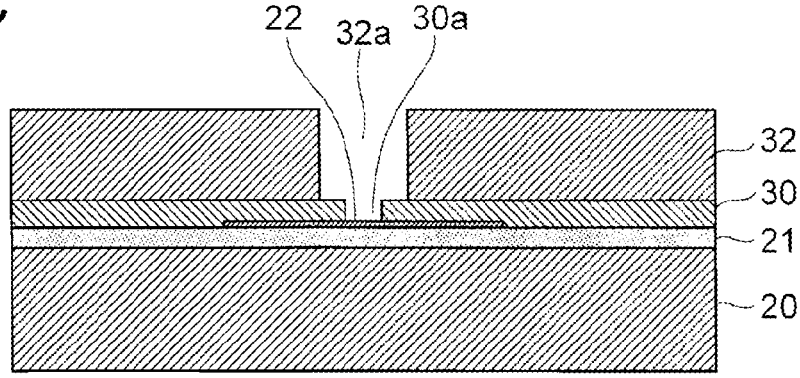
Figure 6D:
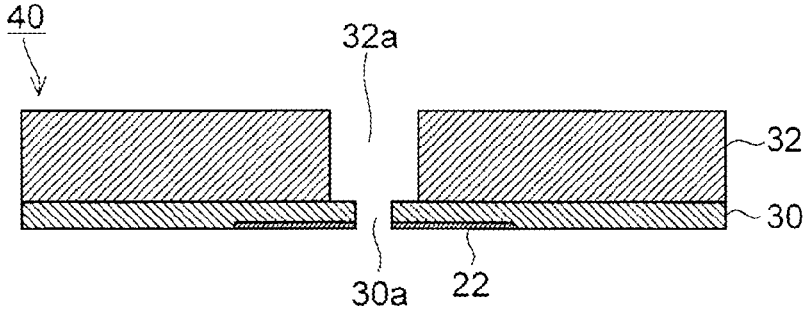

Next, a description will be given of formation of a nozzle in a nozzle sheet. FIGS. 5(*a*) to 5(*c*) and FIGS. 6(*a*) to 6(*d*) are sectional views showing respective steps of forming a nozzle sheet.

First, as shown in FIG. 5(*a*), on the dummy substrate 20 having the liquid-repellent film 22 patterned on it, a first resin sheet 30 is formed. The first resin sheet 30 is made of DFR here, but may instead be made of any other light curable resin that permits use of a photolithographic process. In the first resin sheet 30, a nozzle exit with a small diameter is going to be formed; thus, the first resin sheet 30 is preferably made as thin as practical, for example in the range of from 5 μm to 50 μm.

Next, as shown in FIG. 5(*b*), the first resin sheet 30 is exposed to ultraviolet radiations of predetermined intensity for a predetermined duration through a photomask 31 having a pattern 31*a* of a desired nozzle shape corresponding to a first nozzle formed in it. The pattern 31*a* is given a circular shape here, but may instead be given any other shape, examples including elliptic and polygonal shapes. The intensity of, and the duration of exposure to, ultraviolet radiations may be properly determined according to the thickness of the first resin sheet 30. Next, through baking on a hot plate, the part of the first resin sheet 30 irradiated with ultraviolet radiations is made to crosslink.

Next, as shown in FIG. 5(*c*), with DFR developer liquid, the part of the first resin sheet 30 other than its crosslinked part is dissolved. Thus, in the first resin sheet 30, a through hole according to the pattern 31*a* is formed as a first nozzle 30*a*.

Next, as shown in FIG. 6(*a*), on the first resin sheet 30, a second resin sheet 32 is formed. The second resin sheet 32 is made of DFR here, but may instead be made of any other light curable resin that permits use of a photolithographic process. In the second resin sheet 32, a second nozzle is going to be formed which leads to (communicates with) the first nozzle 30*a* and which has a larger diameter than the first nozzle 30*a*. The second resin sheet 32 is given a thickness, for example, in the range of from 5 μm to 200 μm.

Next, as shown in FIG. 6(*b*), the second resin sheet 32 is exposed to ultraviolet radiations of predetermined intensity for a predetermined duration through a photomask 33 having a pattern 33*a* of a desired nozzle shape corresponding to a second nozzle formed in it. The pattern 33*a* is given a circular shape here, but may instead be given any other shape, examples including elliptic and polygonal shapes. The intensity of, and the duration of exposure to, ultraviolet radiations may be properly determined according to the thickness of the second resin sheet 32. Next, through baking on a hot plate, the part of the second resin sheet 32 irradiated with ultraviolet radiations is made to crosslink.

Next, as shown in FIG. 6(*c*), with DFR developer liquid, the part of the second resin sheet 32 other than its crosslinked part is dissolved. Thus, in the second resin sheet 32, a through hole according to the pattern 33*a* is formed as a second nozzle 32*a*.

Next, as shown in FIG. 6(*d*), through immersion in adhesion layer remover, the adhesion layer 21 is dissolved, and thereby the dummy substrate 20 is peeled off. Thus, a nozzle sheet 40 is obtained which is penetrated by a passage through the second nozzle 32*a*, the first nozzle 30*a*, and the part of the liquid-repellent film 22 forming the exit part of the first nozzle 30*a*.

Figure 7:
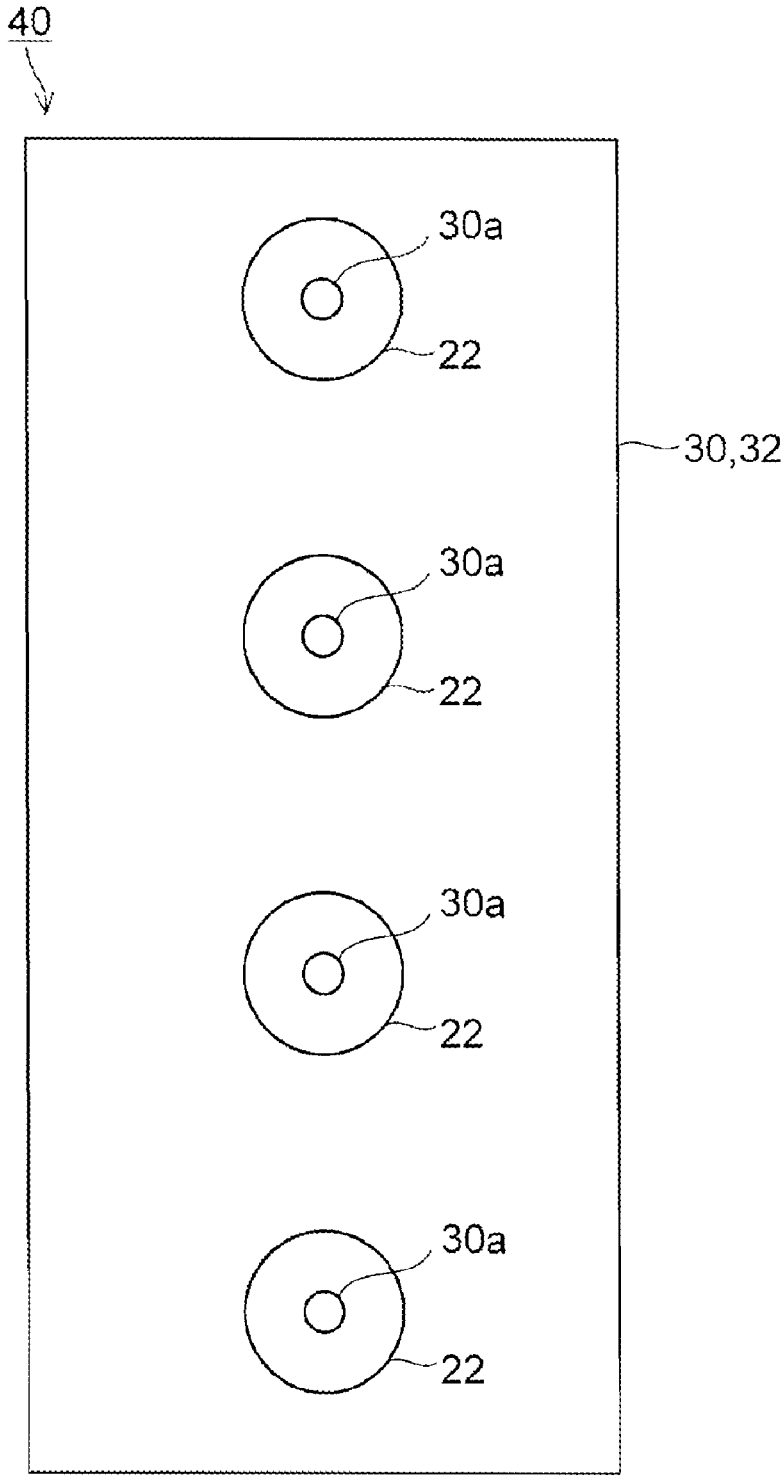
FIG. 7 is a plan view of a nozzle sheet according to the invention.

FIG. 7 is a plan view of the nozzle sheet 40. Although in FIG. 7 the nozzle sheet 40 has liquid-repellent films 22 and first nozzles 30*a* formed at four places on it, in practice their number and arrangement are to be determined to suit a desired nozzle arrangement; for example, a larger number of liquid-repellent films and first nozzles may be arranged in one row, or they may be arranged in plural rows.

It is preferable that the area of the pattern of the liquid-repellent film 22 be five times or more larger than the exit area of the first nozzle 30*a*. This is a ratio of areas necessary to form ink into a meniscus shape at the exit of the first nozzle 30*a*. This permits ink to be propelled stably and orthogonally to the printed surface, and thereby helps to achieve high-resolution printing.

Although the foregoing deals with an example in which two resin sheets are used, the number of resin sheets used may be one, or three or more.

Adopting a nozzle sheet 40 made of resin as described above helps to achieve cost reduction compared with a glass plate as conventionally used.

The formation of a nozzle after the nozzle sheet has been put on the dummy substrate 20 having the liquid-repellent film 22 patterned on it may be done by any other method other than a photolithographic method mentioned above. Such methods include machine processing, laser processing, and imprinting involving a mold being pressed against.

(4) Ink Path Substrate and Ink Tank

Figure 8:
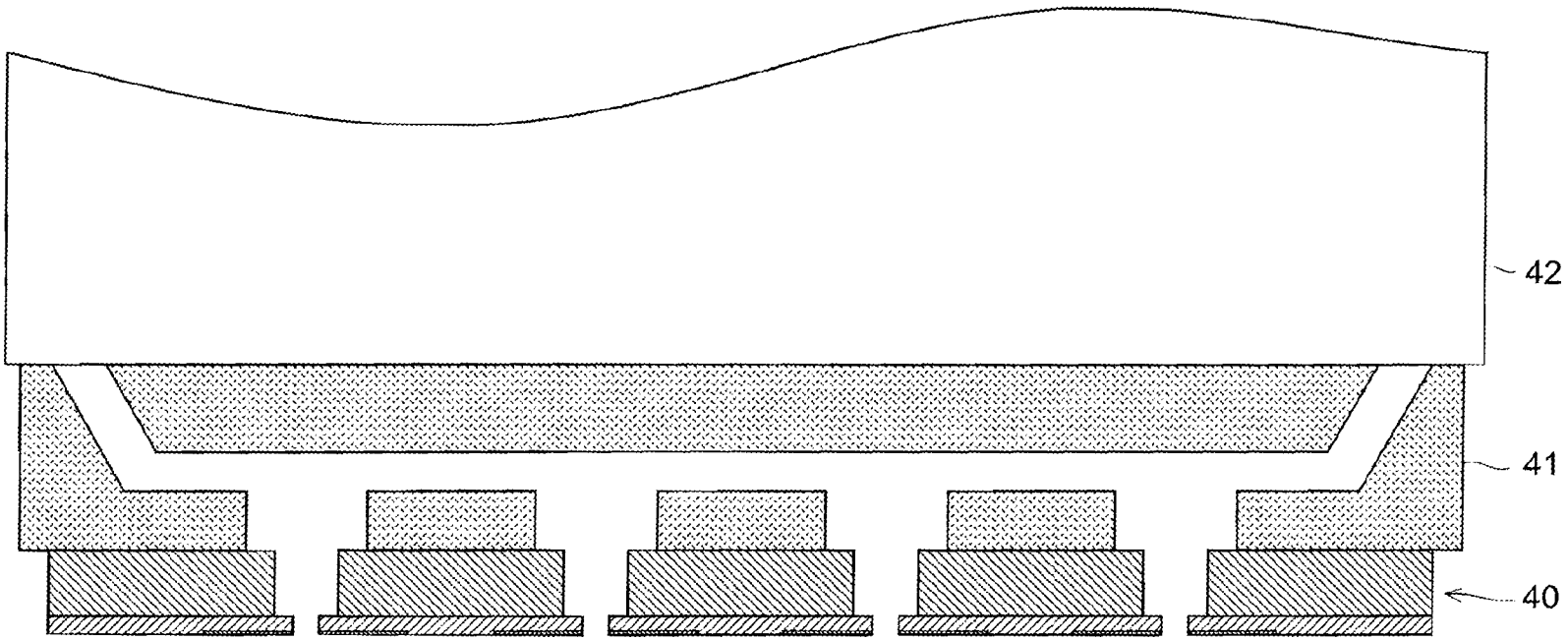
FIG. 8 is a sectional view of and around an inkjet head for an inkjet printer according to the invention.

FIG. 8 is a sectional view of and around an inkjet head for an inkjet printer. The nozzle sheet 40 fabricated as described above is attached to an ink path substrate 41 to form an inkjet head. This inkjet head is assembled into the body of an inkjet printer, and is fitted with an ink tank 42. This permits ink to pass through the ink path substrate 41 to be propelled from the nozzles.

(5) Examples

Next, practical examples will be described. In the following description, members which find their counterparts in the embodiment described above are identified by the same reference signs to allow reference to the relevant drawings.

(5-1) Liquid-Repellent Agent Masking Film

First, on a dummy substrate (second dummy substrate) 10 made of Si, a sacrificial layer (adhesion layer) made of positive resist and having a thickness of 1 μm is applied by use of a spinner (at 2 000 rpm).

Next, on the sacrificial layer 11, a masking film 12 made of DFR and having a thickness of 15 μm is put by use of a laminator.

Next, through a photomask 13 having a circular, 200 μm-across liquid-repellent film pattern 13*a* formed in it, the masking film 12 is exposed to ultraviolet radiations at 35 mJ/cm$^2$. Next, through baking at 95° C. for 6 minutes on a hot plate, the part of the masking film 12 irradiated with ultraviolet radiations is made to crosslink.

Next, through immersion in DFR developer liquid for 7 minutes, the part of the masking film 12 other than its crosslinked part is dissolved. Thus, in the masking film 12, a hole 12*a* according to the pattern 13*a* is formed.

Next, through immersion in sacrificial layer remover, the sacrificial layer 11 is dissolved, and thereby the dummy substrate 10 is peeled off. Thus, a liquid-repellent agent masking film 12 having the through hole 12*a* formed in it is obtained.

(5-2) Dummy Substrate Having a Liquid-Repellent Film Patterned on it

First, on a dummy substrate (first dummy substrate) 20 made of glass, an adhesion layer (sacrificial layer) 21 made of positive resist and having a thickness of 1 μm is applied by use of a spinner (at 2 000 rpm).

Next, on the adhesion layer 21, the masking film 12 is put.

Next, through immersion in liquid-repellent agent followed by lifting up out of it at constant speed (1 mm/sec), the surface of the liquid-repellent agent masking film 12, the inside of the through hole 12*a*, and the surface of the adhesion layer 21 exposed inside the through hole 12*a* are coated with the liquid-repellent agent. Thereafter, the liquid-repellent agent is dried and solidified at room temperature, and thus a liquid-repellent film 22 is obtained.

Next, the liquid-repellent agent masking film is peeled off. Thus, a dummy substrate 20 is obtained which has the liquid-repellent film 22 patterned (with a diameter of 200 μm) only on the part of the surface of the adhesion layer 21 exposed inside the through hole 12*a*.

(5-3) Nozzle Sheet

First, on the dummy substrate 20 having the liquid-repellent film 22 patterned on it, a first resin sheet 30 made of DFR and having a thickness of 15 μm is put by use of a laminator (at a roller pressure of 1 to 3 kPa/cm$^2$, at a temperature of 60° C.).

Next, through a photomask 31 having a circular, 10 μm-across pattern 31*a* of a nozzle shape corresponding to a first nozzle formed in it, the first resin sheet 30 is exposed to ultraviolet radiations at 35 mJ/cm$^2$. Next, through baking at 95° C. for 6 minutes on a hot plate, the part of the first resin sheet 30 irradiated with ultraviolet radiations is made to crosslink.

Next, through immersion in DFR developer liquid for 7 minutes, the part of the first resin sheet 30 other than its crosslinked part is dissolved. Thus, in the first resin sheet 30, a through hole according to the pattern 31*a* is formed as a first nozzle 30*a*.

Next, on the first resin sheet 30, a second resin sheet 32 made of DFR and having a thickness of 50 μm is put by use of a laminator (at a roller pressure of 1 to 3 kPa/cm$^2$, at a temperature of 60° C.).

Next, through a photomask 33 having a circular, 40 μm-across pattern 33*a* of a nozzle shape corresponding to a second nozzle formed in it, the second resin sheet 32 is exposed to ultraviolet radiations at 75 mJ/cm$^2$. Next, through baking at 95° C. for 6 minutes on a hot plate, the part of the second resin sheet 32 irradiated with ultraviolet radiations is made to crosslink.

Next, through immersion in DFR developer liquid for 7 minutes, the part of the second resin sheet 32 other than its crosslinked part is dissolved. Thus, in the second resin sheet 32, a through hole according to the pattern 33*a* is formed as a second nozzle 32*a*.

Next, through immersion in adhesion layer remover, the adhesion layer 21 is dissolved, and thereby the dummy substrate 20 is peeled off. Thus, a nozzle sheet 40 is obtained which is penetrated by a passage through the second nozzle 32*a*, the first nozzle 30*a*, and the part of the liquid-repellent film 22 forming the exit part of the first nozzle 30*a*. The nozzle-to-nozzle distance is set at 500 μm.

INDUSTRIAL APPLICABILITY

The present invention finds application in nozzle sheets for use in inkjet heads for inkjet printers, and in methods of manufacture of such nozzle sheets.

LIST OF REFERENCE SYMBOLS

20 First Dummy Substrate
11 Sacrificial Layer
12 Liquid-Repellent Agent Masking Film
13, 31, 33 Photomask
21 Adhesion Layer
22 Liquid-Repellent Film
30 First Resin Sheet
30*a* First Nozzle
32 Second Resin Sheet
32*a* Second Nozzle
40 Nozzle Sheet

The invention claimed is:

1. A method for manufacturing a nozzle sheet used for an inkjet head for an inkjet printer comprising:
- providing a first dummy substrate;
- patterning a liquid-repellent film on the first dummy substrate;
- forming a first resin sheet on the first dummy substrate to cover the liquid-repellent film;
- forming a first nozzle in the first resin sheet which penetrates through the first resin sheet, and forms a nozzle exit on a surface of the first resin sheet adjoining the liquid-repellent film; and
- peeling the first dummy substrate off the first resin sheet thereby forming the nozzle sheet wherein the first resin sheet surface surrounding the nozzle exit is covered by the liquid-repellent film, which prevents wetting of the first resin sheet surface surrounding the nozzle exit by ink, and wherein an inner surface of the first nozzle is free from the liquid-repellent film.

2. The method of claim 1, wherein the first resin sheet is made of light curable resin.

3. The method of claim 1, wherein the first resin sheet is made of dry film resist.

4. The method of claim 1, wherein the forming the first nozzle comprises:
- exposing the first resin sheet to ultraviolet radiations through a first photomask;
- baking the first resin sheet to make the ultraviolet-irradiated part of the first resin sheet crosslink; and
- dissolving the part other than the crosslinked part of the first resin sheet with developer.

5. The method of claim 1, further comprising, between the forming first nozzle and the peeling the first dummy substrate:
- forming a second resin sheet on the first resin sheet; and
- forming a second nozzle which penetrates through the second resin sheet and leads to the first nozzle, the diameter of the second nozzle being larger than that of the first nozzle.

6. The method of claim 5, wherein the second resin sheet is made of light curable resin.

7. The method of claim 5, wherein the second resin sheet is made of dry film resist.

8. The method of claim 5, wherein the forming second nozzle comprises:
- exposing the second resin sheet to ultraviolet radiations through a second photomask;
- baking the second resin sheet to make the ultraviolet-irradiated part of the second resin sheet crosslink; and
- dissolving the part other than the crosslinked part of the second resin sheet with developer.

9. The method of claim 1, wherein the area of the patterned liquid-repellent film on the second resin sheet is five times or more larger than the exit area of the first nozzle.

10. The method of claim 1, wherein the patterning a liquid-repellent film on the first dummy substrate comprises:
- forming an adhesion layer on the first dummy substrate;
- putting a masking film on the adhesion layer;
- forming a liquid-repellent material over the masking film;
- drying and solidifying the liquid-repellent material; and
- peeling the masking film off the first dummy substrate.

11. The method of claim 10, wherein the masking film is prepared by:

forming a sacrificial layer on a second dummy substrate;

forming a dry film resist layer on the sacrificial layer;

exposing the dry film resist layer to ultraviolet radiations through a third photomask;

baking the dry film resist layer to make the ultraviolet-irradiated part of the dry film resist layer crosslink;

dissolving the part other than the crosslinked part of the dry film resist layer with developer; and peeling the second dummy substrate off the dry film resist layer by using sacrificial layer remover.

12. A nozzle sheet manufactured by the method of claim 1.

13. The method of claim 10, wherein the first dummy substrate is peeled off the first resin sheet by using adhesion layer remover in the peeling the first dummy substrate.

* * * * *